US005592048A

United States Patent [19]

Wei et al.

[11] Patent Number: 5,592,048

[45] Date of Patent: Jan. 7, 1997

[54] ARC TUBE ELECTRODELESS HIGH PRESSURE SODIUM LAMP

[75] Inventors: George C. Wei, Weston; Walter P. Lapatovich, Marlborough, both of Mass.; Paul H. Ingalls, Penacook, N.H.

[73] Assignee: Osram Sylvania Inc., Danvers, Mass.

[21] Appl. No.: 516,885

[22] Filed: Aug. 18, 1995

[51] Int. Cl.[6] ..... H01J 17/20; H01J 61/12; H01J 1/62; H01J 63/04

[52] U.S. Cl. ..... 313/570; 313/490; 313/493; 315/248

[58] Field of Search ..... 313/564, 570–574, 313/491–493, 634–639, 642, 643, 160, 161; 501/32; 315/248, 344

[56] References Cited

U.S. PATENT DOCUMENTS

| | | | |
|---|---|---|---|
| 3,319,119 | 5/1967 | Rendina | 315/248 |
| 3,520,039 | 7/1970 | Olson et al. | 313/636 X |
| 4,150,317 | 4/1979 | Laska et al. | 313/636 X |
| 4,182,972 | 1/1980 | Kaneno et al. | 313/636 |
| 4,373,030 | 2/1983 | Kaneno et al. | 313/636 |
| 4,435,669 | 3/1984 | Plagge et al. | 313/636 X |
| 4,545,799 | 10/1985 | Rhodes et al. | 65/59.21 |
| 4,721,886 | 1/1988 | Oomen et al. | 313/625 X |
| 4,765,820 | 8/1988 | Naganawa et al. | 313/625 X |
| 4,803,403 | 2/1989 | Makar, Jr. et al. | 313/624 |
| 4,868,457 | 9/1989 | Strok | 313/639 X |
| 4,950,953 | 8/1990 | Ito et al. | 313/564 |
| 5,150,017 | 9/1992 | Geens et al. | 313/642 X |
| 5,352,952 | 10/1994 | Juengst | 313/625 X |
| 5,426,343 | 6/1995 | Rhodes et al. | 313/625 X |

*Primary Examiner*—Sandra L. O'Shea
*Assistant Examiner*—Mack Haynes
*Attorney, Agent, or Firm*—William H. McNeill

[57] ABSTRACT

Electrodeless arc tubes for high pressure sodium discharge lamps comprise a substantially tubular, translucent body formed from a material comprising sintered polycrystalline alumina. The body has an inside diameter and an outside diameter and a given length. A fill comprising sodium and xenon are loaded within the body. At least one end-seal is provided for the body, the end-seal comprising a first alumina disc sealed within the inside diameter by compression, the first disc being spaced inwardly from an end of the body and having a substantially centrally located aperture therein. A second alumina disc seals the aperture, the second disc being bonded to the first disc and to the inner wall of the body by a sealing frit.

6 Claims, 2 Drawing Sheets

ARC TUBE ELECTRODELESS HIGH PRESSURE SODIUM LAMP

TECHNICAL FIELD

This invention relates to arc tubes for discharge lamps and more particularly to arc tubes for an electrodeless, high pressure sodium lamp.

BACKGROUND ART

High pressure sodium lamps employing polycrystalline alumina arc tubes having tungsten electrodes at either end thereof are known, see, for example, U.S. Pat. No. 4,545,799. Such electrodes often employ electron emissive materials such as barium, strontium, calcium, yttrium, tungsten or mixtures thereof. During lamp operation these materials are sputtered from the electrodes and deposit on the interior of the arc tube envelope, leaving a black coating thereon which can increase the emissivity of the arc tube and decrease the wall temperature. These effects lead to a lowering of the lamp efficacy. Additionally, the use of electrodes can lead to cracking of the material due to the expansion differences between the metal and ceramic.

DISCLOSURE OF INVENTION

It is, therefore, an object of the invention to obviate the disadvantages of the prior art.

It is another object of the invention to enhance the operation of high pressure sodium lamps.

Yet another object of the invention is an increase in efficacy of high pressure sodium lamps.

Still another object of the invention is the simplification of arc tube construction and the elimination of thermal cracking due to differences in thermal expansion.

These objects are accomplished, in one aspect of the invention, by the provision of an electrodeless arc tube for a high pressure sodium discharge lamp comprising: a substantially tubular, translucent body formed from a material comprising sintered polycrystalline alumina, said body having an inside diameter and an outside diameter and a given length; a fill comprising sodium and xenon within said body; and at least one end-seal for said body, said end-seal comprising a first alumina disc sealed within said inside diameter by compression, said first disc being spaced inwardly from an end of said body and having a substantially centrally located aperture therein; and a second alumina disc sealing said aperture, said second disc being bonded to said first disc and to the inner wall of said body by a sealing frit.

The elimination of the electrodes removes the deleterious materials from the interior of the arc tube resulting in greater transparency for longer periods of time, thus increasing the efficacy of the lamps employing the same. Also eliminated is any thermal mismatch.

BEST MODE FOR CARRYING OUT THE INVENTION

For a better understanding of the present invention, together with other and further objects, advantages and capabilities thereof; reference is made to the following disclosure and appended claims taken in conjunction with the above-described drawings.

Figure 1:
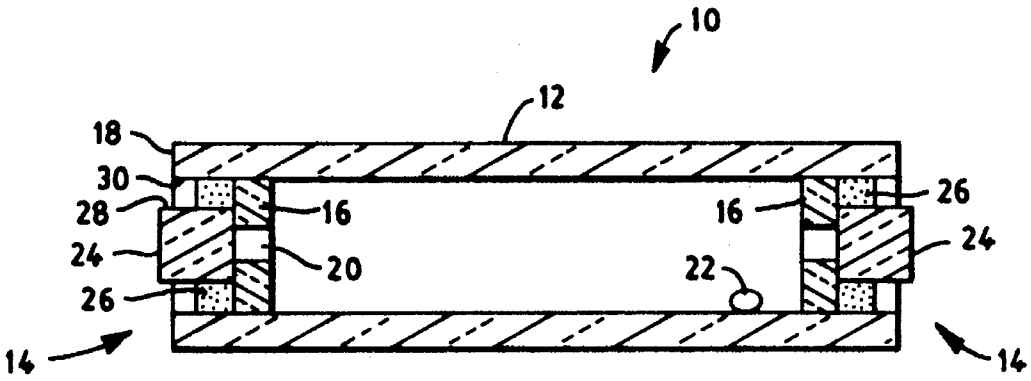
FIG. 1 is an elevational, sectional view of an embodiment of the invention.

Referring now to the drawings with greater particularity, there is shown in FIG. 1 an electrodeless arc tube 10 comprised of a substantially tubular, translucent body 12 formed from a material comprising sintered polycrystalline alumina, as is known in the art. This material can include small quantities of numerous additives such as magnesia, yttria, zirconia and hafnia for the control of grain growth or to prevent undesired phases from forming in the material. In a preferred embodiment of the invention, body 12 comprised alumina containing 500 ppm magnesia and 350 ppm yttria. Average grain size was between 25–30 μm. The total transmittance was 95–96% and the in-line transmission was 5–6%.

Figure 2:
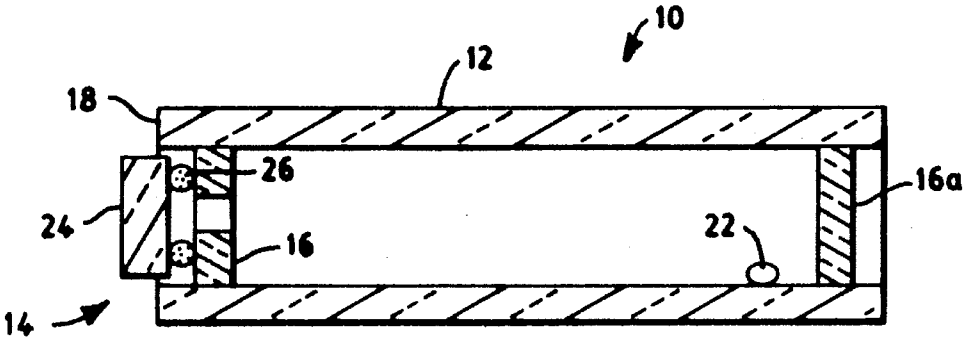
FIG. 2 is an elevational, sectional view of an alternate embodiment.

The body 12 has an inside diameter and an outside diameter and a given length. In a preferred embodiment, the body has an inner diameter of 4.0 mm; an outside diameter of 5.2 mm and a cavity length of 30.0 mm. At least one end of the body 12 is closed by an end-seal 14 which comprises a first alumina disc 16 sealed within the body by a compression or fritless seal, as discussed in the above-cited U.S. Pat. No. 4,545,799. The first disc 16 is spaced inwardly from an end 18 of the body 12 to form a recess and has a substantially centrally located aperture 20 therein. The aperture 20 is employed as the dosing or fill aperture whereby the fill 22 can be inserted into the arc tube before final sealing. A second alumina disc 24 is inserted into the recess formed by first disc 16 and the end 18 of body 12 and is sealed therein by a sealing frit 26 which can be in the form of a ring positioned between the outside surface 28 of second disc 24 and the inner surface 30 of body 12. Alternatively, the sealing material can be placed beneath the second disc 24, as is shown in FIG. 2.

The fill 22 is at least sodium and preferably comprises a sodium amalgam. For the arc tube having the dimensions described above it is preferred that the fill comprise 2.3 mg of the sodium amalgam with a weight ratio of sodium to mercury of 20:80. The gaseous portion of the fill comprises xenon at 25 torr. Excessive fill weights are to be avoided as they can cause problems in coupling with a high frequency power source.

While any of the known sealing frits available for use with ceramic tubes can be employed the preferred frit is known as PF and comprises 45.6 weight percent $Al_2O_3$; 1.6 weight percent $B_2O_3$; 5.2 weight percent MgO; 8.6 weight percent BaO; and 39 weight percent CaO.

Figure 3:
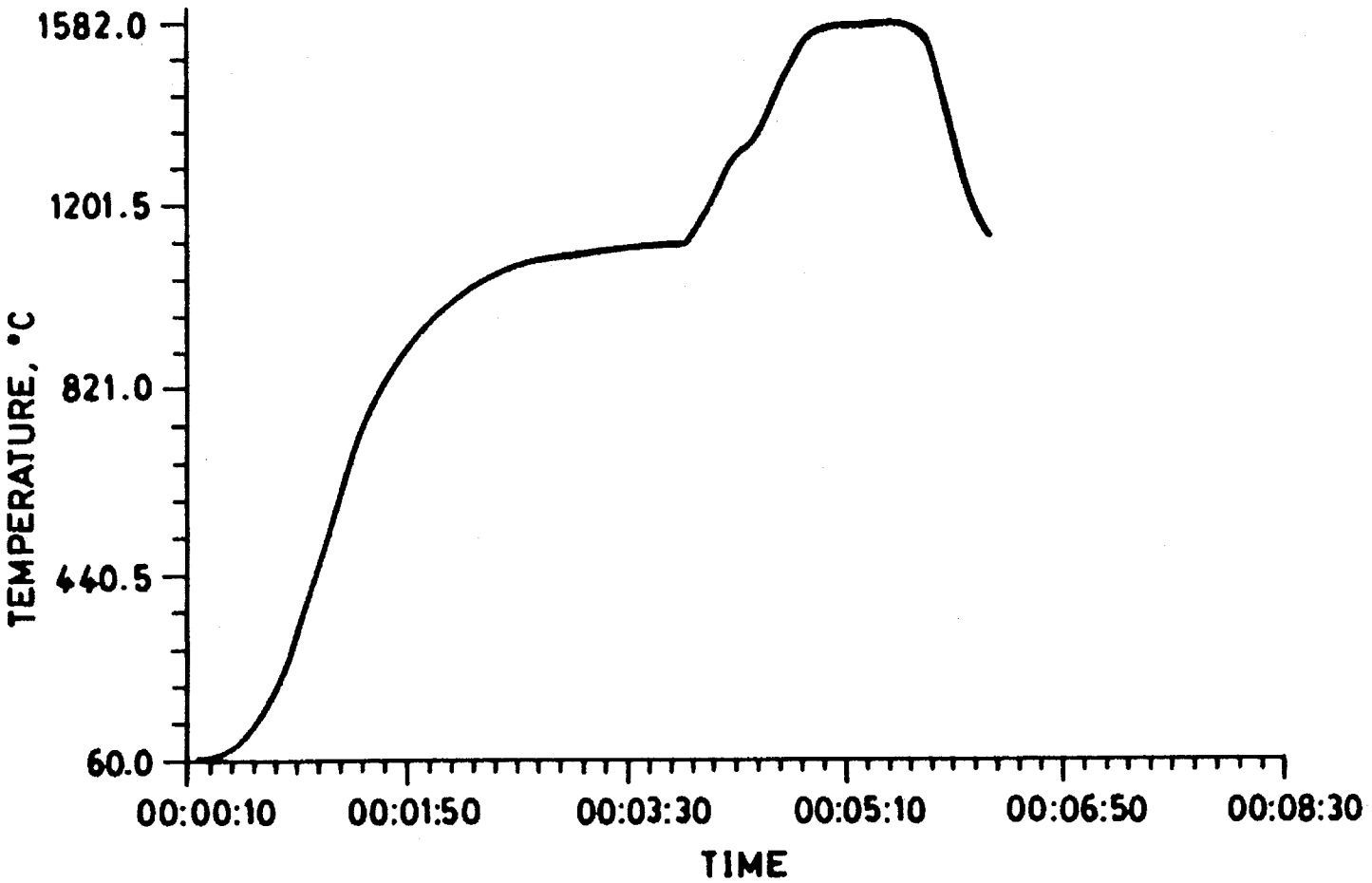
FIG. 3 is graph of a firing schedule for frit sealing.

When the PF frit is used the sealing furnace is preferably a graphite element, carbon-fiber-insulation lined, water-cooled, cold wall furnace with a vacuum system containing xenon gas fill provisions. The tube-disc-frit assembly is loaded in a copper tray, placed in the furnace and pumped to $<10^{-5}$ torr. The heating cycle employed for sealing with the PF frit is shown in FIG. 3. Other frits would require different sealing times and temperatures.

If desired, a solid first disc **16*a*, such as is shown in FIG. 2, can be employed to seal one of the ends, the opposite end requiring an apertured disc 16** to allow insertion of the fill material.

The arc tubes are energized by placement in a high energy field. A suitable arrangement is shown in U.S. Pat. No.

5,070,277 wherein the operational frequency is 915 MHz. Of course, other frequencies are useable; e.g., those prefered are within allowed International Scientific and Medical (ISM) bands and in particular the band centered about 2.45 GHz.

Arc tubes operated thusly showed strong sodium emissions, indicating that a complete discharge and the light emissions of high pressure sodium lamps were achieved. Operation for several hours showed no end blackening which provides a major advantage over conventional electroded high pressure sodium lamps. As a result of the no-blackening, the lumen output, efficacy and life of the electrodeless lamps can be higher than those of the electroded counterparts.

While them have been shown and described what are at present considered the preferred embodiments of the invention, it will be apparent to those skilled in the art that various changes and modifications can be made herein without departing from the scope of the invention as defined by the appended claims.

What is claimed is:

1. An electrodeless arc tube for a high pressure sodium discharge lamp comprising: a substantially tubular, translucent body formed from a material comprising sintered polycrystalline alumina, said body having an inside diameter and an outside diameter and a given length; a fill comprising sodium and xenon within said body; and at least one end-seal for said body, said end-seal comprising a first alumina disc sealed within said inside diameter by compression, said first disc being spaced inwardly from an end of said body and having a substantially centrally located aperture therein; and a second alumina disc sealing said aperture, said second disc being bonded to said first disc and to the inner wall of said body by a sealing frit.

2. The arc tube of claim 1 wherein said material includes up to 500 ppm magnesia.

3. The arc tube of claim 2 wherein said material includes up to 350 ppm yttria.

4. The arc tube of claim 1 wherein said sodium is introduced into said arc tube body as an amalgam.

5. The arc tube of claim 4 wherein said amalgam comprised a weight ratio of sodium to mercury of 20:80.

6. The arc tube of claim 5 wherein said xenon is at a pressure of 25 torr.

* * * * *